US005494504A

United States Patent [19]

Wright

[11] Patent Number: 5,494,504

[45] Date of Patent: Feb. 27, 1996

[54] LIQUID RINSE CONDITIONER FOR PHOSPHATE CONVERSION COATINGS

[75] Inventor: Angela Wright, Lake Orion, Mich.

[73] Assignee: PPG Industries, Inc., Pittsburgh, Pa.

[21] Appl. No.: 304,049

[22] Filed: Sep. 12, 1994

[51] Int. Cl.[6] ..... C23C 22/07

[52] U.S. Cl. ..... 106/14.12; 106/14.44; 106/14.05; 148/253; 148/254; 148/259; 148/261

[58] Field of Search ..... 148/254, 259, 148/261, 253; 106/14.05, 14.12, 14.44

[56] References Cited

U.S. PATENT DOCUMENTS

| | | | |
|---|---|---|---|
| 2,310,239 | 2/1943 | Jernstedt | 148/254 |
| 2,456,947 | 12/1948 | Jernstedt | 148/254 |
| 2,516,008 | 7/1950 | Lum | 148/254 |
| 2,874,081 | 2/1959 | Cavanagh et al. | 148/254 |
| 4,152,176 | 5/1979 | Guhde | 148/254 |
| 4,517,030 | 5/1985 | Yamamoto et al. | 148/254 |
| 4,678,519 | 7/1987 | Schapira et al. | 148/254 |
| 4,859,358 | 8/1989 | Gabriel et al. | 252/99 |
| 4,957,568 | 9/1990 | Endres et al. | 148/254 |
| 5,026,423 | 6/1991 | Ngo | 148/254 |
| 5,112,395 | 5/1992 | Ngo | 148/254 |
| 5,160,551 | 11/1992 | Rein et al. | 148/254 |
| 5,326,408 | 7/1994 | Cormier | 148/254 |

FOREIGN PATENT DOCUMENTS

| | | | |
|---|---|---|---|
| 554179 | 8/1993 | European Pat. Off. | 148/259 |
| 2806342 | 8/1978 | Germany | 148/259 |
| 3731089 | 3/1989 | Germany | 148/254 |
| 2131052 | 6/1984 | United Kingdom | 148/261 |

*Primary Examiner*—Anthony Green
*Attorney, Agent, or Firm*—Kenneth J. Stachel; William J. Uhl

[57] ABSTRACT

The present invention relates to an improved titanium containing phosphate composition and a process for preparing the titanium containing phosphate composition. The composition in the form of a dilute aqueous dispersion is useful as a rinse conditioner for activating ferrous, zinc and aluminum metal surfaces prior to the application of phosphate conversion coatings. The rinse conditioner forms stable baths and can be used for activating metal surfaces for extended periods of time.

36 Claims, No Drawings

LIQUID RINSE CONDITIONER FOR PHOSPHATE CONVERSION COATINGS

FIELD OF THE INVENTION

This invention relates to rinse conditioners which are used to treat metal substrates prior to the application of phosphate conversion coatings and to a method of preparing the rinse conditioners.

BACKGROUND OF THE INVENTION

Phosphate conversion coatings are well known for treating metal surfaces, particularly ferrous, zinc and aluminum metals and their alloys. When applied, these phosphate coatings form a phosphate film, primarily of zinc phosphate or iron phosphate, which provides corrosion resistance and enhances the adhesion of subsequently applied coatings. Complete metal coverage and ultimately better phosphate coating properties can be achieved with phosphate crystals characterized by a fine and densely packed crystal structure. On the other hand, large, loosely packed phosphate crystals result in inadequate coverage which yields defective phosphate coating layers.

To achieve the desired crystal structure, the metal is usually conditioned or activated prior to applying the phosphate coating. Activation is done by contacting the metal surface with a diluted aqueous dispersion of a so called rinse conditioner or activator. These rinse conditioners or activators are also commonly known in the art as activating agents, nucleating agents, crystal refiners or grain refiners. For the purposes of this disclosure, the terms rinse conditioner or activator will be used.

Rinse conditioners are aqueous dispersions which contain Jernstedt salts such as those described in U. S. Pat. Nos. 2,310,239 and 2,456,947. Jernstedt salts are colloidal salts of disodium phosphate and a multivalent metal, such as, titanium, zirconium, lead and tin. Titanium (IV) phosphate salts are typically preferred for economic and environmental reasons.

The rinse conditioner is typically applied to the metal surface by immersing the metal in a bath of the rinse conditioner or by spraying the rinse conditioner onto the metal surface. It is believed the rinse conditioner creates nucleating sites such that when the phosphate conversion coating is applied, fine, densely packed crystals form.

Preparation of the titanium phosphate salt complex can be achieved in several ways under various conditions. In general, a titanium compound is reacted with phosphoric acid in the presence of sodium hydroxide, a sodium phosphate salt or combination of sodium phosphate salts, at a temperature of between 65° C. to 100° C. The salt is usually recovered as a solid and is transferred to the application site in this form.

A disadvantage of having the titanium phosphate salt complex in solid form is that it must be put in aqueous medium at the application site. This is usually accomplished by making a concentrated aqueous slurry which is then diluted with additional water or is metered directly into an immersion tank which contains a dilute aqueous solution or dispersion of the salt and which is being used to condition metal surfaces. Unfortunately, the concentrated aqueous slurries based on the sodium phosphate salts are not particularly stable and have a tendency to settle out and to lose their activity and plug the pumps associated with the metering equipment. These slurries typically require daily preparation and constant agitation to insure the activity of the rinse conditioner and to prevent solid material from clogging metering pump lines. It would therefore be desirable to formulate a rinse conditioner of the Jernstedt salt type which would overcome the problems associated with the Jernstedt salts recovered in solid form as mentioned above.

SUMMARY OF THE INVENTION

The present invention provides for a Jernstedt salt type rinse conditioner which is initially prepared in the form of a concentrated aqueous dispersion which has excellent stability in that it does not require agitation, it maintains its activity and does not clog metering pumps. The rinse conditioner composition comprises a sodium phosphate, a potassium phosphate and titanium, in which the titanium is present as a complex salt with either or both sodium phosphate and the potassium phosphate. The sodium content measured as sodium metal is from 6 to 14 percent by weight based on solids weight of the composition; the potassium content measured as potassium metal is from 20 to 40 percent by weight based on solids weight of the composition; the weight ratio of sodium to potassium measured as metals is 0.25 to 0.5:1; the phosphorus content measured as phosphorus metal is from 16 to 22 percent by weight based on solids weight of the composition; and the titanium content measured as titanium metal is from 0.1 to 0.6 percent by weight based on solids weight of the composition.

The rinse conditioner composition can be formulated as a concentrated aqueous dispersion having a solids content of at least 40 percent by weight based on the weight of the concentrated aqueous dispersion. In addition, the present invention provides a process for preparing a titanium containing phosphate composition described above which comprises: (a) mixing in an aqueous medium a sodium phosphate with a titanium containing compound and heating said mixture at 65° C. to 95° C. to form a product. The product (a) is then combined with a potassium phosphate to form a concentrated aqueous dispersion of a titanium containing phosphate composition.

DETAILED DESCRIPTION OF THE INVENTION

The titanium containing phosphate composition of the present invention comprises a sodium phosphate, a potassium phosphate and titanium, in which the titanium is present as a complex salt in combination with either or both the sodium phosphate or the potassium phosphate.

Suitable sodium phosphates useful in the practice of the present invention can be represented by the general formula:

$$Na_mH_{3-m}PO_4,\ Na_pH_{n+2-p}P_nO_{3n+1} \text{ and } (NaPO_3)_q$$

wherein m is 1, 2, or 3; n is 2, 3, or 4; p is 1, 2 . . . n+2; and q is an integer of from 2 to 20. Examples include: mono- di- or tri-sodium phosphate, pentasodium triphosphate (also known as sodium tripolyphosphate), tetrasodium diphosphate or combinations thereof.

The potassium phosphates useful in the practice of the present invention can be represented by the general formula:

$$K_mH_{3-m}PO_4,\ K_pH_{n+2-p}P_nO_{3n+1} \text{ and } (KPO_3)_q$$

wherein m is 1, 2, or 3; n is 2, 3, or 4; p is 1, 2 . . . n+2; and q is an integer of from 2 to 20. Examples include: mono-, di- or tri- potassium phosphate, pentapotassium triphosphate (also known as potassium tripolyphosphate), dipotassium orthophosphate, tetrapotassium pyrophosphate or combinations thereof.

A variety of titanium (IV) compounds or salts may be used as the source of titanium in the titanium containing phosphate composition as long as the anion of the salt does not interfere with the subsequent phosphate pretreatment. Titanium halides, titanium oxides, titanium sulfates and titanium oxalates may be used. While the selection of the titanium source is not limited, titanium halides, specifically potassium titanium fluoride is preferred.

Typical amounts of sodium, potassium, titanium and phosphorus used in the practice of the invention can be determined by atomic absorption spectroscopy and are expressed as sodium, potassium, titanium and phosphorus metal, respectively. These measurements, usually reported as percent, are based on known standard references and calibration curves. The claimed composition contains 6 to 14 percent sodium, 20 to 40 percent potassium, 0.1 to 0.6 percent titanium and 16 to 22 percent phosphorus, the percentage of metal being based on solids weight of the composition. The weight ratio of sodium to potassium measured as metals is 0.25 to 0.5:1. Ratios of sodium to potassium within this range result in the highest solubility of the resulting phosphate salts.

The titanium containing phosphate composition is preferably in liquid form. The liquid composition is in the form of a concentrated aqueous dispersion which usually has a solids content of at least 40 percent by weight based on the weight of the concentrated aqueous dispersion. The preferred solids content is between 40 and 60 percent based on the weight of the concentrated aqueous dispersion. The concentrated aqueous dispersion can be readily diluted with water to form a diluted aqueous dispersion for treating metal surfaces. The solids content of the diluted aqueous dispersion is typically between 0.05 to 2 percent by weight based on the weight of the diluted aqueous dispersion. An advantage of the concentrated aqueous dispersion over the solid activators is that the concentrated aqueous dispersions are considerably easier to dilute with water to achieve-the desired solids content in the diluted aqueous dispersion. In addition, the concentrated aqueous dispersions can be metered directly into a bath tank via pumps, eliminating the need for the preparation of an aqueous slurry and constant agitation of the slurry (prior to introduction into the bath tank), as is the case with solid rinse conditioners.

Additional optional components which may be useful in the present invention include diphosphonic acids, alkali metal carbonates or hydroxides and/or thickening agents. The diphosphonic acids which may be used can be described by the following structure:

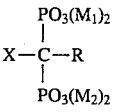

wherein R is a phenyl group which is unsubstituted or para-substituted by a halogen, amino, hydroxy or a $C_1$ to $C_4$ alkyl group or straight chain, branched or cyclic saturated or mono- or poll/unsaturated alkyl group having 1 to 10 carbon atoms; X is hydrogen, hydroxy, halogen or amino; and $M_1$ and $M_2$ each independently represent hydrogen and or alkali/metal ion. When used, hydroxyethyl diphosphonic acid is typically present in amounts of between 0.1 to 5 percent by weight based on solids weight of the titanium containing phosphate composition. These diphosphonic acids tie up hard water salts (i.e., they have a water softening effect) which increases the longevity of the rinse conditioner bath by preventing agglomeration of the suspended titanium phosphate complex salts.

Alkali metal carbonates and/or alkali metal hydroxides, such as potassium and sodium, can be used to adjust the pH of the bath to the desired range and increase the solubility of the sodium phosphate salts thereby increasing bath lifetime. These alkali metal carbonates or hydroxides are typically added in amounts of from 0.2 to 10 percent by weight based on solids weight of the titanium containing phosphate composition.

Thickening compounds, such as xanthans, polysaccharides and polycarboxylates can be used to keep the dispersed solids from settling and aid in maintaining hard water stability. Polycarboxylate acrylic thickening agents are preferred, such as those described in U.S. Pat. No. 4,859,358. The polycarboxylate acrylic thickening agent is present in amounts of from 0.05 to 1 percent by weight based on solids weight of the titanium containing phosphate composition. An example of a preferred polycarboxylate acrylic thickening agent is Carbopol, made by B. F. Goodrich.

The titanium containing phosphate composition is typically prepared by mixing in an aqueous medium a sodium phosphate with a titanium compound and heating said mixture to achieve a temperature of between about 65° C. to about 95° C. to form a pre-mix. The pre-mix is generally prepared by adding pentasodium triphosphate to water which is heated to achieve a temperature of between about 65° C. and about 95° C. The titanium compound is then added and agitated. After thorough mixing, the disodium orthophosphate is added and mixed thoroughly for about 5 to 15 minutes while maintaining the temperature. This pre-mix will form a paste-like titanium phosphate complex salt.

Suitable sodium phosphates useful in the preparation of the pre-mix are those which have been described above. Disodium orthophosphate and disodium orthophosphate in combination with pentasodium triphosphate are preferred. The use of disodium orthophosphate in combination with pentasodium triphosphate is most preferred. The titanium source in the pre-mix can be titanium sulfate, potassium titanium fluoride, titanium dioxide or other titanium compounds such as those mentioned above. Potassium titanium fluoride is the preferred source of titanium.

The pre-mix is then typically combined with a potassium phosphate to form a concentrated aqueous dispersion of a titanium containing phosphate composition. The pre-mix paste may be added to the potassium phosphate hot or after a cooling period. It should be noted that the potassium phosphate may also be added to the pre-mix. The potassium phosphate may be one or a combination of the potassium phosphates described above. It is generally preferred to use dipotassium orthophosphate or a combination of dipotassium orthophosphate and pentapotassium triphosphate. Tetrapotassium pyrophosphate is additionally preferred when activating aluminum substrates.

Typically, the sodium phosphate is present in amounts of from 10 to 30 percent by weight, the potassium phosphate is present in amounts of from 20 to 40 by weight, the titanium is present in amounts of from 0.05 to 2.5 percent by weight and water is present in amounts of from 30 to 60 percent by weight, the percentage by weight based on the total weight of the ingredients used in the making of the titanium containing phosphate composition. Usually, the sodium phosphate is disodium orthophosphate in combination with pentasodium triphosphate, and the disodium orthophosphate is present in amounts of from 10 to 25 percent by weight and the pentasodium triphosphate is present in amounts of from 1 to 10 percent by weight, the percentage by weight being based on total weight of the ingredients used in the making of the titanium containing phosphate composition. The potassium phosphate is preferably dipotassium orthophosphate in combination with pentapotassium triphosphate, and the dipotassium orthophosphate is typically present in amounts of from 5 to 20 percent by weight and the pentapotassium triphosphate is present in amounts of from 10 to 25 percent by weight, the percentage by weight being based on total weight of the ingredients used in the making of the titanium containing phosphate composition. In the case where tetrapotassium pyrophosphate is additionally used in the practice of the present invention, it is present in amounts of up to 5 percent by weight based on total weight of the ingredients used in the making of the titanium containing phosphate composition.

The combination of potassium and sodium phosphate salts are considerably more soluble in water than potassium salts alone, which are more soluble than sodium salts alone. The use of potassium salts in combination with sodium salts allow the formulation of rinse conditioners which are liquid dispersions, which are more stable and easier to handle and use than solid rinse conditioners formulated with sodium salts. In addition, rinse conditioners formulated with the potassium salts require less titanium for comparable activation.

The titanium containing phosphate composition may also contain diphosphonic acids, an alkali carbonate and/or hydroxide and/or a thickening agent, preferably a polycarboxylate acrylic, such as those described above. These materials are usually added to the concentrated aqueous dispersion.

The concentrated aqueous dispersion typically has a solids content of 40 to 60 percent by weight and a pH between 8.0 and 11.0. The preferred solids content and pH range are 45–55 percent and 8.0–9.5, respectively. Prior to use as an activating agent, the concentrated aqueous dispersion is diluted further with water until the solids content of the dilute aqueous dispersion is between 0.05 to 2 percent by weight. This can be accomplished by dilution with fresh water or by metering into an immersion bath of rinse conditioner which is being used to treat metal surfaces.

The metal substrates contacted by the dilute aqueous dispersion or rinse conditioner are zinc, ferrous or aluminum metal and their alloys. A typical treatment process would include cleaning the metal substrate by a mechanical or chemical means, such as abrading the surface or cleaning the surface with commercial alkaline/caustic cleaners. The cleaning process is then usually followed by a water rinse before contacting the substrate with the diluted rinse conditioner.

The rinse conditioner can be applied to the substrate by spray, roll-coating or immersion techniques. The rinse conditioner solution is typically applied at a temperature between 20° C .and 50° C. After the metal surface has been activated, the surface is subjected to phosphate pretreatment. The phosphatization step can be performed by spray application or immersion of the activated metal surface in an acidic phosphate bath which contains zinc and other divalent metals known in the art at a temperature of typically 35° C. to 75° C. for 1 to 3 minutes. After phosphatization, the substrate is optionally post-rinsed with a chromium or non-chromium containing solution, rinsed with water and optionally dried. Paint is then typically applied, such as, by electrodeposition or by conventional spray or roll coating techniques.

The rinse conditioners useful in the practice of the present invention have advantages over those currently used in the market because they are supplied in the form of a concentrated liquid dispersion which can be metered via pumps directly into a dilute rinse conditioner bath tank. These concentrated liquid rinse conditioners are stable for at least three months, unlike solid rinse conditioners which require a daily dispersion preparation step and constant agitation to maintain the integrity of the dispersion prior to metering into the tank. In addition, the concentrated liquid rinse conditioner remains active for long periods of time even at high concentration levels of dispersed total solids.

The present invention is further illustrated by the following non-limiting examples. All parts and amounts are by weight unless otherwise indicated.

EXAMPLES

The following examples show the preparation of the titanium containing phosphate compositions of the present invention and their evaluation as liquid rinse conditioners. Cleaned metal surfaces were activated with the rinse conditioners, subjected to phosphate pretreatment and evaluated for corrosion resistance and adhesion.

Example A Preparation of Pre-mix of Titanium Phosphate composition

To a stainless steel vessel, large enough to hold 150 gallons of liquid, was added 110 pounds of tap water (at 130°–140° F. or 54°–60° C.). With vigorous agitation, 40 pounds of sodium tripolyphosphate and 10 pounds of potassium titanium fluoride were added. After about 3 minutes of mixing 193 pounds of disodium phosphate was added to the mixing vessel. An exothermic reaction resulted in a temperature rise up to approximately 170° F. (77° C.). The consistency of the mix changed from fluid to a thick paste pre-mix.

Example 1 Preparation of Liquid Rinse Conditioner

To Example A was added in the following order with high shear mixing: 363 pounds of tap waters 210 pounds of potassium tripolyphosphate, 388 pounds of dipotassium phosphate (50%), 14 pounds of HEDP (optional), 36 pounds of potassium carbonate (optional) and 14 pounds of tetrapotassium polyphosphate (60%) (optional). High shear mixing was continued until a thick homogeneous dispersion was obtained, then, 3.5 pounds of Carbopol 676 was sifted in slowly. High shear mixing was continued until a uniform, thickened dispersion having a solids content of about 51% by weight was produced. The liquid rinse conditioner was evaluated as described below.

Example 2 Preparation of Comparative Solid Rinse Conditioner

For the purposes of comparison, a solid rinse conditioner containing only sodium phosphate salts (no potassium phosphate salts) and titanium salts available from PPG Industries, Inc. (CHEMFIL Division) as RINSE CONDITIONER was slurried into water evaluated as described below.

Test Results

The solid rinse conditioner is slurried in water in a holding tank to form a slurry having a solids content of about 118 grams per liter (approximately 1 pound per gallon). The slurry requires constant agitation to keep the solids dispersed. The slurry is then pumped from the holding tank into the processing bath via a metering pump. One disadvantage of this approach is that if the agitation is interrupted for even a short period of time, the dispersed rinse conditioner settles out and causes the metering pump to clog.

The liquid rinse conditioner of the present invention eliminates the need to produce a dispersion in a holding tank which would require constant agitation. The liquid rinse conditioner, which readily disperses, is metered directly into a processing bath from the drum supplied. In addition, the liquid rinse conditioner does not produce dust, which may cause paint defect problems if the pretreatment line in proximity to the paint line.

The performance of the liquid rinse conditioner was compared to the solid rinse conditioner at equivalent concentrations. Using the standard zinc phosphating sequence described below, the activity of the two products was compared.

1. Alkaline clean with CHEMKLEEN 165 available from PPG Industries, Inc. (CHEMFIL Division).
2. Warm water rinse.
3. Activate with RINSE CONDITIONER or Liquid Rinse Conditioner of the present invention at a concentration of 1 gram per liter water.
4. Zinc Phosphate with CHEMFOS 700 available from PPG Industries, Inc. (CHEMFIL Division).
5. Cold water rinse.
6. Final rinse with CHEMSEAL 59 available from PPG Industries, Inc. (CHEMFIL Division).
7. Deionized water rinse.
8. Air dry.

Metal panels, treated as described above, were examined by Scanning Electron Microscopy for coating morphology (measured by crystal size in microns) and uniformity (measured by completeness of coverage). The results comparing the liquid rinse conditioner of the present invention, compared to a solid rinse conditioner, are given in the Table I below.

TABLE I

| | Coating Morphology measured as Zinc Phosphate crystal Size in microns | | Coating Uniformity measured as percent coverage of substrate by Zinc Phosphate crystals | |
|---|---|---|---|---|
| METAL SUB-STRATE | Liquid Rinse Conditioner | Solid Rinse Conditioner | Liquid Rinse Conditioner | Solid Rinse Conditioner |
| Cold-rolled Steel | 1–3 | 1–3 | 100 | 100 |
| Electro-galvanized Steel | 2–4 | 2–5 | 100 | 100 |
| Aluminum (6111) | 1–4 | 1–4 | 100 | 100 |

For the data in Table I above it can be seen that the liquid rinse conditioner of the present invention provides equivalent results to the solid rinse conditioner of the prior art without the disadvantages associated with the solid rinse conditioner.

I claim:

1. A process for preparing a titanium containing phosphate composition which comprises:

(a) mixing in an aqueous medium a sodium phosphate in amounts of 10 to 30 percent by weight with a titanium compound to form a mixture and heating said mixture to achieve a temperature of between about 65° C. to about 95° C. followed by (b) combining said mixture of (a) with a potassium phosphate in amounts of 20 to 40 percent by weight to form a concentrated aqueous dispersion of a titanium containing phosphate composition with titanium phosphate complex salts, wherein water is present in amounts of 30 to 60 percent by weight, wherein the percentages by weight are based on the total weight of ingredients which are used in the making of the titanium phosphate composition, and wherein the solids content is of at least 40 percent by weight based on weight of the concentrated aqueous dispersion.

2. The process of claim 1 wherein the sodium phosphate corresponds to the general formula:

$$Na_mH_{3-m}PO_4,\ Na_pH_{n+2-p}P_nO_{3n+1} \text{ and } (NaPO_3)_q$$

wherein m is 1, 2, or 3; n is 2, 3, or 4; p is 1, 2 up to n+2; q is an integer of from 2 to 20.

3. The process of claim 1 wherein the sodium phosphate is selected from the group consisting of $Na_2HPO_4$ and a mixture of $Na_2HPO_4$ with $Na_5P_3O_{10}$.

4. The process of claim 1 wherein the titanium compound is a titanium potassium fluoride.

5. The process of claim 1 wherein said potassium phosphate corresponds to the general formula:

$$K_mH_{3-m}PO_4,\ K_pH_{n+2-p}P_nO_{3n+1} \text{ and } (KPO_3)_q$$

wherein m is 1, 2, or 3; n is 2, 3, or 4; p is 1, 2 up to n+2; and q is an integer of from 2 to 20.

6. The process of claim 1 wherein the potassium phosphate is selected from the group consisting of $K_2HPO_4$ and a mixture of $K_2HPO_4$ with $K_5P_3O_{10}$.

7. The process of claim 1 wherein the potassium phosphate is a mixture of $K_2HPO_4$ with $K_5P_3O_{10}$ and $K_4P_2O_7$.

8. The process of claim 1 wherein the titanium is present in amounts of 0.05 to 2.5 percent by weight based on total weight of ingredients which are used in the making of the titanium phosphate composition.

9. The process of claim 3 wherein the sodium phosphate is a mixture of $Na_2HPO_4$ with $Na_5P_3O_{10}$ wherein the $Na_2HPO_4$ is present in amounts of 10 to 25 percent by weight and the $Na_5P_3O_{10}$ is present in amounts of 1 to 10 percent by weight, based on the total weight of the sodium phosphate, titanium compound, and potassium phosphate used in making the titanium containing phosphate composition.

10. The process of claim 6 wherein the potassium phosphate is a mixture of $K_2HPO_4$ with $K_5P_3O_{10}$ wherein $K_2HPO_4$ is present in amounts of 5 to 20 percent by weight and $K_5P_3O_{10}$ is present in amounts of 10 to 25 percent by weight; the percentage by weight based on the total weight of the sodium phosphate, titanium compound, and potassium phosphate used in making the titanium containing phosphate composition.

11. The process of claim 7 wherein the $K_4P_2O_7$ is present in amounts of up to 5 percent by weight based on total weight of the sodium phosphate, titanium compound, and potassium phosphate used in making the titanium containing phosphate composition.

12. The process of claim 1 wherein a diphosphonic acid is added to the titanium containing phosphate composition to prevent agglomeration of suspended titanium phosphate complex salts which are present in the titanium containing phosphate composition.

13. The process of claim 12 wherein the diphosphonic acid is of the following structural formula:

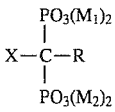

wherein R is a phenyl group which is unsubstituted or substituted in the para position by a halogen, amino, hydroxy or a $C_1$ to $C_4$ alkyl group or straight chain, branched or cyclic saturated or mono- or polyunsaturated alkyl group having 1 to 10 carbon atoms; X is hydrogen, hydroxy, halogen or amino; and $M_1$ and $M_2$ each independently are selected from the group consisting of: hydrogen and alkali metal ion.

14. The process of claim 1 wherein a diphosphonic acid is added to the titanium containing phosphate composition in amounts of 0.1 to 5 percent by weight based on solids weight of the titanium containing phosphate composition.

15. The process of claim 1 wherein alkali metal carbonate or alkali metal hydroxide is added to the titanium containing phosphate composition to adjust the pH of the concentrated aqueous dispersion of the titanium containing phosphate composition and increase the solubility of sodium phosphate salts which are present in the concentrated aqueous dispersion.

16. The process of claim 15 wherein the alkali metal carbonate or hydroxide is potassium carbonate or hydroxide.

17. The process of claim 15 wherein the alkali metal carbonate or hydroxide is sodium carbonate or hydroxide.

18. The process of claim 1 wherein metal carbonate or alkali metal hydroxide is added to the titanium containing phosphate composition in amounts of 0.2 to 10 percent by weight based on solids weight of the titanium containing phosphate composition.

19. The process of claim 1 wherein a polycarboxylate acrylic thickening agent is added to the titanium containing phosphate composition in an amount that is sufficient to keep dispersed solids present in the titanium containing phosphate composition from settling and to aid in maintaining hard water stability.

20. The process of claim 1 wherein a polycarboxylate acrylic thickening agent is added to the titanium containing phosphate composition in amounts of from 0.05 to 1 percent by weight based on solids weight of the titanium containing phosphate composition.

21. The process of claim 1 wherein the titanium containing phosphate composition is a concentrated aqueous dispersion having a solids content of 40 to 60 percent by weight, based on the weight of the concentrated aqueous dispersion.

22. The process of claim 1 wherein the concentrated aqueous dispersion has a pH of 8.0 to 11.

23. A composition which when in aqueous solution is capable of activating ferrous, zinc or aluminum metal surfaces prior to the application of protective phosphate coatings which comprises a sodium phosphate, a potassium phosphate and titanium, in which the titanium is present as a complex salt with either or both of the sodium phosphate and the potassium phosphate, and the amount of sodium measured as sodium metal is from 6 to 14 percent by weight, based on solids weight of the composition; the amount of potassium measured as potassium metal is from 20 to 40 percent by weight, based on solids weight of the composition; the weight ratio of sodium to potassium measured as metals is 0.25 to 0.5:1; the amount of phosphorus measured as phosphorus metal is from 16 to 22 percent by weight, based on solids weight of the composition; and the titanium content measured as titanium metal is from 0.1 to 0.6 percent by weight, based on solids weight of the composition.

24. The composition of claim 23 in liquid form.

25. The composition of claim 24 in the form of a concentrated aqueous dispersion having a solids content of at least 40 percent by weight based on weight of the concentrated aqueous dispersion.

26. The composition of claim 25 wherein the solids content is from 40 to 60 percent by weight.

27. The composition of claim 24 in the form of a diluted aqueous dispersion having a solids content of 0.05 to 2 percent by weight based on weight of the diluted aqueous dispersion.

28. The composition of claim 24 which further comprises a diphosphonic acid to prevent agglomeration of suspended titanium phosphate complex salts which are present in the titanium containing phosphate composition.

29. The composition of claim 28 wherein the diphosphonic acid is of the following structural formula:

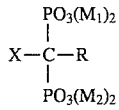

where R is a phenyl group which is unsubstituted or substituted in the para position by a hydrogen, amino, hydroxy or a $C_1$ to $C_4$ alkyl group or straight chain, branched or cyclic saturated or mono- or polyunsaturated alkyl group having from 1 to 10 carbon atoms; X is hydrogen, hydroxy, halogen or amino; and $M_1$ and $M_2$ each independently are selected from the group consisting of: hydrogen and alkali metal ion.

30. The composition of claim 23 which additionally contains alkali metal carbonate or alkali metal hydroxide to adjust the pH of the titanium containing phosphate composition and increase the solubility of sodium phosphate salts which are present in the concentrate aqueous dispersion.

31. The composition of claim 30 wherein the alkali metal carbonate or hydroxide is potassium carbonate or hydroxide.

32. The composition of claim 30 wherein the alkali metal carbonate or hydroxide is sodium carbonate or hydroxide.

33. The composition of claim 23 which additionally contains a polycarboxylate acrylic thickening agent in an amount that is sufficient to keep dispersed solids present in the titanium containing phosphate composition from settling and to aid in maintaining hard water stability.

34. The composition of claim 23 which further comprises a diphosphonic acid which is present in amounts of 0.1 to 5 percent by weight based on solids weight of the composition.

35. The composition of claim 23 which additionally contains alkali metal carbonate or alkali metal hydroxide present in amounts of from 0.2 to 10 percent by weight based on solids weight of the composition.

36. The composition of claim 23 which additionally contains a polycarboxylate acrylic thickening agent present in amounts of from 0.05 to 1 percent by weight based on solids weight of the composition.

* * * * *

UNITED STATES PATENT AND TRADEMARK OFFICE

CERTIFICATE OF CORRECTION

PATENT NO. : 5,494,504

DATED : February 27, 1996

INVENTOR(S) : Angela Wright

It is certified that error appears in the above-indentified patent and that said Letters Patent is hereby corrected as shown below:

Column 9,

Claim 18, line 1: insert --alkali-- before the word "metal".

Signed and Sealed this

Twenty-seventh Day of August, 1996

*Attest:*

Bruce Lehman

BRUCE LEHMAN

*Attesting Officer*

*Commissioner of Patents and Trademarks*